US009932683B2

(12) United States Patent
Barker et al.

(10) Patent No.: US 9,932,683 B2
(45) Date of Patent: Apr. 3, 2018

(54) METHOD FOR METAL ELECTROWINNING AND AN ELECTROWINNING CELL

(71) Applicant: OUTOTEC (FINLAND) OY, Espoo (FI)

(72) Inventors: Michael H. Barker, Pori (FI); Henri K. Virtanen, Pori (FI)

(73) Assignee: OUTOTEC (FINLAND) OY, Espoo (FI)

( * ) Notice: Subject to any disclaimer, the term of this patent is extended or adjusted under 35 U.S.C. 154(b) by 119 days.

(21) Appl. No.: 14/895,260

(22) PCT Filed: May 30, 2014

(86) PCT No.: PCT/FI2014/050439
§ 371 (c)(1),
(2) Date: Dec. 2, 2015

(87) PCT Pub. No.: WO2014/195574
PCT Pub. Date: Dec. 11, 2014

(65) Prior Publication Data

US 2016/0115609 A1 Apr. 28, 2016

(30) Foreign Application Priority Data

Jun. 5, 2013 (FI) ..... 20135622

(51) Int. Cl.
*C25C 1/00* (2006.01)
*C25C 7/06* (2006.01)
(Continued)

(52) U.S. Cl.
CPC ..... *C25C 7/06* (2013.01); *C25C 1/12* (2013.01); *C25C 1/16* (2013.01); *C25C 7/00* (2013.01); *C25C 7/02* (2013.01)

(58) Field of Classification Search
CPC .... C25C 7/06; C25C 1/12; C25C 1/16; C25C 7/02; C25C 7/00
See application file for complete search history.

(56) References Cited

U.S. PATENT DOCUMENTS 1,260,830 A 3/1918 Studt
2,273,795 A 2/1942 Heise et al.
(Continued)

FOREIGN PATENT DOCUMENTS

CA 1120423 A 3/1982
CA 2175270 A1 11/1996
WO WO 2007/045716 A1 4/2007

OTHER PUBLICATIONS

International Search Report (PCT/ISA/210) dated Sep. 11, 2014, by the European Patent Office as the International Searching Authority for International Application No. PCT/FI2014/050439.
(Continued)

*Primary Examiner* — Arun S Phasge
(74) *Attorney, Agent, or Firm* — Buchanan, Ingersoll & Rooney PC

(57) ABSTRACT

The invention relates to a method for electrowinning a metal from an electrolyte in an electrowinning cell that comprises an electrolysis tank, one or more anodes, and one or more cathodes, which anodes and cathodes are housed in the electrolysis tank. The method comprises supplying sulfur dioxide to the anode to depolarize the anode process and to reduce the energy consumption of the electrowinning cell.

19 Claims, 2 Drawing Sheets

(51) Int. Cl.

| | |
|---|---|
| ***C25C 1/12*** | (2006.01) |
| ***C25C 1/16*** | (2006.01) |
| ***C25C 7/00*** | (2006.01) |
| ***C25C 7/02*** | (2006.01) |

(56) References Cited

U.S. PATENT DOCUMENTS

| | | | |
|---|---|---|---|
| 2,273,797 | A | 2/1942 | Heise et al. |
| 4,019,968 | A | 4/1977 | Spaziante et al. |
| 4,087,339 | A | 5/1978 | Elliott et al. |
| 4,149,944 | A | 4/1979 | Goddard et al. |
| 4,431,496 | A | 2/1984 | Remick |
| 2006/0021880 | A1 | 2/2006 | Sandoval et al. |

OTHER PUBLICATIONS

International Preliminary Report on Patentability (PCT/IPEA/409) dated Aug. 13, 2015 for International Application No. PCT/FI2014/050439 (11 pages).

B. Panda et al., "Electrowinning of Copper From Sulfate Electrolyte in Presence of Sulfurous Acid", Hydrometallurgy, vol. 59, No. 1, Jan. 1, 2001, pp. 55-67.

L.A. Knerr, "Sulfur Dioxide Depolarized Gas Diffusion Electrodes for Copper Electrowining", Extended Abstracts, Electrochemical Society, vol. 87-1, Mar. 21, 1987, pp. 474-475.

Douglas Robinson et al., "Commercial Development of a Descending Packed Bed Electrowinning Cell, Part 2: Cell Operation", Hydrometallurgy, vol. 2, Aug. 1, 2003, pp. 1395-1403.

Approval of Acceptance issued by the Finnish Patent and Registration Office in corresponding Finnish Patent Application No. 20135622 dated Apr. 13, 2017 (3 pages).

Search Report issued by the Finnish Patent and Registration Office in corresponding Finnish Patent Application No. 20135622 dated Feb. 4, 2014 (1 page).

METHOD FOR METAL ELECTROWINNING AND AN ELECTROWINNING CELL

FIELD OF THE INVENTION

The present invention relates to a method for electrowinning a metal from an electrolyte in an electrowinning cell that comprises an electrolysis tank, one or more anodes and one or more cathodes, which anodes and cathodes are housed in the electrolysis tank. The invention also relates to an electrowinning cell for electrowinning a metal.

BACKGROUND OF THE INVENTION

In metal electrowinning a current is passed from an inert anode to a cathode through a liquid leach solution containing said metal so that the metal is extracted as it is deposited onto the cathode. A significant part of the specific electrical energy consumption (SEEC) for this process is due to the reaction which occurs at the anode. In the case of copper this represents over 25% of the total energy requirement of the copper production.

In sulfate based electrolytes the anode reaction is oxygen evolution, caused by electrolytic splitting of water into protons and oxygen. This provides electrons for the reduction of metal cations at the cathode. Sulfate based electrolytes are used, for instance, in electrowinning of copper, zinc, nickel, chromium and manganese.

In metal electrowinning from sulfate (or sulfuric acid) based electrolytes, the oxygen evolution reaction that occurs at the anode is given by the following equation:

$$H_2O \rightarrow 2H^+_{(aq)} + \tfrac{1}{2}O_{2(g)} + 2e^- \quad (1)$$

$E^0 = +1.23$ V vs. SHE

The overall reaction for copper electrowinning with an oxygen-evolving anode is given by equation (2). The reaction produces one mole of cathode copper, one mole of sulfuric acid and half a mole of oxygen gas:

$$CuSO_{4(aq)} + H_2O \rightarrow Cu_{(s)} + H_2SO_{4(aq)} + \tfrac{1}{2}O_{2(g)} \quad (2)$$

$E_{cell} = +1.7$ to $2.0$ V vs. SHE

Efficiency and cost-effectiveness of electrowinning is important for the competitiveness of metal industry. The electrical energy cost of metal electrowinning is almost directly proportional to cell voltage.

Attempts have been made to develop anodes that would reduce the energy required for electrowinning. These attempts comprise, for instance, modification of lead anodes and switching to dimensionally stable anodes (DSA). In most cases, the anticipated energy savings have been in the region of a few hundreds of millivolts, or 5-15% of the cell voltage.

Dimensionally stable anodes comprise a thin active coating, usually few microns, deposited on a base metal, such as Ti, Zr, Ta, Nb. The coating enables the electrical charge transport between the base metal and the electrode/electrolyte interface, and is chosen for its high chemical and electrochemical stability and its ability to catalyze the desired electrochemical reaction.

PURPOSE OF THE INVENTION

The object of the present invention is to reduce the electrical power consumption in metal electrowinning.

SUMMARY

The invention comprises the use of sulfur dioxide depolarized electrolysis (SDE) to lower the cell voltage for metal electrowinning, thereby lowering the electrical power needed to win metals from a solution. Anodic oxidation of $SO_2$ is used to depolarize the anode reaction and to decrease the energy required for electrowinning.

By comparison with the oxygen evolution reaction (1), sulfur dioxide oxidation reaction (3) has a much lower standard electrode potential than oxygen evolution:

$$SO_{2(diss)} + 2H_2O_{(1)} \rightarrow H_2SO_{4(aq)} + 2H^+_{(aq)} + 2e^- \quad (3)$$

$E^0 = +0.17$ V vs. SHE

The overall reaction for sulfur dioxide depolarized copper electrowinning would then be the production of one mole of cathode copper, two moles of acid and no oxygen. The cell voltage is considerably lower than for standard copper electrowinning technology:

$$CuSO_{4(aq)} + SO_{2(diss)} + 2H_2O_{(1)} \rightarrow Cu_{(s)} + 2H_2SO_{4(aq)} \quad (4)$$

$E_{cell} \sim +1.0$ V vs. SHE

The method according to the present invention is characterized by what is presented in claim 1.

The electrowinning cell according to the present invention is characterized by what is presented in claim 10.

In the present invention, anolyte and catholyte are separated from each other by a diaphragm or membrane, and sulfur dioxide is supplied to the anode to depolarize the anode process and to reduce the energy consumption of the electrowinning cell.

In one embodiment of the invention, sulfur dioxide is introduced in gas form into the electrolysis tank in the vicinity of the anode.

In another embodiment of the invention, sulfur dioxide is dissolved into an electrolyte before said electrolyte is introduced into the electrolysis tank in the vicinity of the anode.

In an advantageous embodiment of the present invention, each anode is housed in an anode bag of its own and sulfur dioxide is introduced into the lower part of the anode bag.

In one embodiment of the present invention, the anode comprises a titanium mesh coated with platinum.

In another embodiment of the present invention, the anode comprises a titanium mesh coated with gold.

In an advantageous embodiment of the present invention, the titanium mesh comprises 0.10-0.50 g/cm$^2$ Ti, advantageously about 0.15 g/cm$^2$ Ti.

In one embodiment of the present invention, the anode is a standard PbCaSn anode spray-coated with platinum powder. Alternatively, the standard PbCaSn anode can be spray-coated with gold powder.

In another embodiment of the present invention, the anode comprises a stainless steel anode coated with platinum or gold. Coating can be carried out, for instance, by powder coating, electrolytical precipitation, or any other suitable technology.

The present invention may be employed, for instance, in copper or zinc electrowinning carried out in a strong $H_2SO_4$ based electrolyte. The new method can also be suitable for use in nickel, chromium or manganese electrowinning, depending on the impact of $SO_2$ on the solution chemistry of those processes.

With sulfur dioxide depolarized electrowinning technology (SDD-EW), it is possible to depolarize the electrowinning anode reaction by as much as 1 volt and so decrease the cell voltage and energy consumption in copper electrowinning by approximately 50%.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
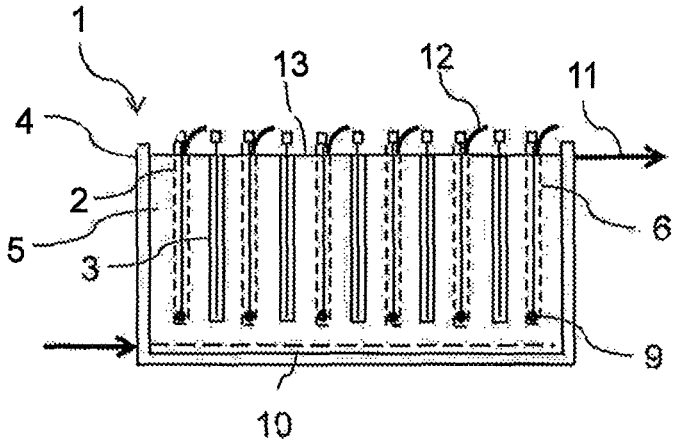
FIG. 1 is a schematic cross-sectional view of a sulfur dioxide depolarized electrowinning cell comprising bagged anodes.

FIG. 1 shows an electrolytic cell 1 that can be used in $SO_2$ depolarized electrowinning of copper from an acid electrolyte 5 that contains sulfuric acid and its copper salt. The electrolytic cell 1 comprises a plurality of anodes 2 and a plurality of cathodes 3, which are arranged alternately in an electrolysis tank 4 filled with the electrolyte 5. The anodes 2 can be, for instance, platinum or gold plated titanium mesh anodes, or of any other suitable type. Each anode 2 is contained in an anode bag 6 of its own. The anode bags 6 are formed of a material that permeates the electrolyte 5 in a controlled manner. The cathodes 3 are preferably permanent cathodes, which are made of acid-resistant special steel. The cathodes 3 are in direct contact with the electrolyte 5 in the tank 4.

Catholyte, which contains copper sulfate and sulfuric acid, is fed to the bottom of the tank 4 via a main feed manifold 10. After flowing through the tank 4, the spent catholyte is removed as an overflow 11 from the upper part of the tank 4. Anolyte, together with dissolved $SO_2$, is fed into the lower part of each anode bag 6 via an anolyte feed manifold 9. The spent anolyte is removed from the upper part of the anode bag 6 via a conduit 12 with the aid of vacuum. The anolyte and the catholyte are separated from each other by the anode bag 6, which can comprise a diaphragm cloth bag or an ion exchange membrane, such as Nafion 117. The ion exchange membrane is a functionally fixed electrolyte that serves as an electric insulator and as a proton conductor that prevents gases from flowing from one side of the membrane to the other side of it.

Figure 2:
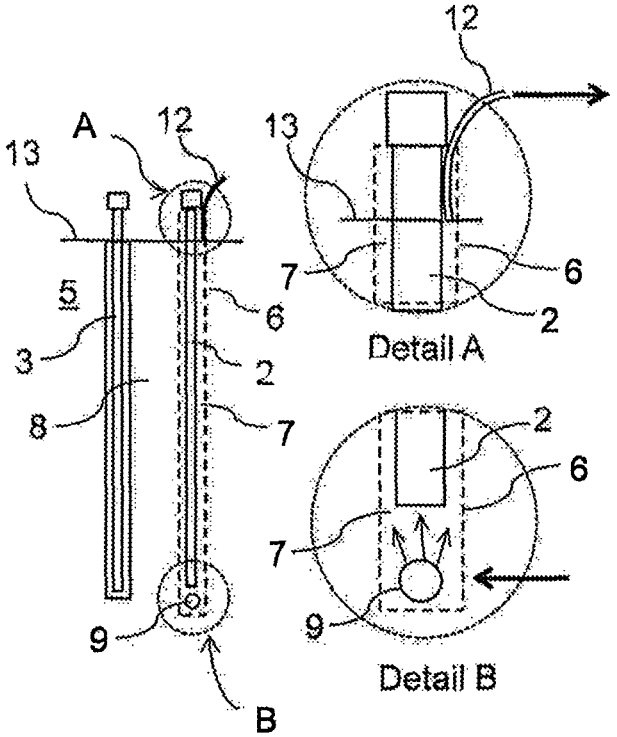
FIG. 2 is an enlarged view of two electrodes, illustrating the flow of dissolved $SO_2$ containing anolyte through an anode bag, with two enlarged detail drawings.

FIG. 2 shows on a larger scale the structure of the anode 2 placed in the anode bag 6 and the cathode 3 placed outside the anode bag 6. The anode bag 6 defines an anodic space 7 on its inside and a cathodic space 8 on its outside. In the lower part of the anodic space 7 there is a manifold 9 through which anolyte is fed into the anode bag 6 together with $SO_2$ gas dissolved in the anolyte. Copper is precipitated on the surface of the cathode 3 and sulfuric acid is generated at the anode 2.

The spent anolyte, along with any excess gas including $SO_2$, is removed from the anode bag 6 with the aid of suction via the conduit 12 arranged in connection with the air/electrolyte interface 13 in the upper part of the anode bag 6. The spent anolyte with increased concentration of $H_2SO_4$ is conducted to recirculation.

The aqueous solution introduced into the anodic space 7 together with the sulfur dioxide results in oxidation of gaseous sulfur dioxide ($SO_2$) to form sulfur acid ($H_2SO_4$) with a sulfur dioxide depolarized anode.

In a preferred embodiment of the invention, the apparatus comprises means for adding sulfur dioxide to the anolyte solution, which solution is fed to the anodic space 7 via anolyte feed manifold 9.

As sulfur dioxide is consumed in electrolysis, some $SO_2$ make up is needed in the process.

In metallurgical industry, a large amount of sulfur dioxide is formed in roasting and smelting processes, i.e. the exhaust gases contain essentially large amounts of sulfur dioxide. The present invention is suitable for use in connection with metal production processes involving a pyrometallurgical step producing $SO_2$ and an electrowinning step to deposit metal on cathodes. The $SO_2$ producing step may comprise, for instance, roasting or smelting of sulfidic raw materials. Normally, the new type of electrowinning step would be suitable for zinc or nickel production, whereby $SO_2$ would be used in sulfur dioxide depolarized anodes in the electrowinning part of the process. If there is no $SO_2$ available from the process, then other sources of $SO_2$ can be considered. Sulfur dioxide can be transported from a near-by process plant, or a sulfur burner can be used to generate the necessary $SO_2$. Furthermore, sulfuric acid evolved in the electrolytic cell can be re-circulated to a leaching stage.

In principle, there are several alternative ways of supplying $SO_2$ to the anodes in an electrolytic cell. The first alternative, illustrated in FIGS. 1 and 2, comprises dissolving $SO_2$ gas in the anolyte before the electrolytic cell 1 and feeding the solution via the manifold 9 to the bottom of the anode bag 6. Spent anolyte that contains residual $SO_2$ will then be re-circulated separately from the bulk electrolyte (catholyte). Any emissions will be handled by removal of electrolyte from the top of the anode bag 6. Fresh anolyte that contains dissolved $SO_2$ can be fed into the lower part of the anode bag 6 via the manifold 9 consisting of a steel tube, or by a device similar to that used in air sparging. Alternatively, $SO_2$ gas can be supplied directly into the anode bag without prior dissolution in an electrolyte.

Another option of supplying $SO_2$ to anodes in the electrolytic cell comprises using stacked membrane electrolyser assemblies (MEA), such as those related to descending packed bed electrowinning cell technology. In this cell design, anolyte and catholyte are treated as separate feeds and anolyte gas handling is part of the cell design. An example of this is presented in S. Robinson et al. "Commercial development of a descending packed bed electrowinning cell, part 2: Cell operation", Hydrometallurgy 2003—Fifth International Conference in Honor of Professor Ian Ritchie—Volume 2: Electrometallurgy and Environmental Hydrometallurgy, TMS, 2003.

One more option would be dissolving $SO_2$ gas in the electrolyte feed prior to its addition to an undivided cell. An acid mist capture hood would then be needed to control the tankhouse atmosphere.

The potential at which the reactions (2) and (3) occur depends strongly on the anode material. For example, in an electrowinning tankhouse of prior art, reaction (2) typically occurs on lead based anodes (PbCaSn for copper electrowinning; PbAg for zinc electrowinning). Lead, or more specifically lead oxide on the surface of the lead anode is not a particularly good catalyst for oxygen evolution; platinum and gold would be much better catalysts. The use of lead-based anodes persists in electrowinning applications for cost reasons—lead is a low cost option.

The material costs of anodes suitable for use in sulfur dioxide depolarized (SDD) metal electrowinning can be very high. The SDD anode itself appears to be competitive with conventional dimensionally stable anode (DSA), and there may be even cost reduction if it is possible to use light titanium mesh based SDD anodes.

It is estimated that sulfur dioxide depolarized copper electrowinning would potentially save about 49% on the energy by using the oxidation of sulfur dioxide as the anode reaction.

The benefits achieved by the new method are numerous. Electrical energy consumption is reduced by approximately half over standard PbCaSn based copper electrowinning. There is no oxygen evolution at the anode. Together with the use of anode bags, this will yield elimination of acid mists and better environmental control, which is especially important for instance in nickel electrowinning. As there are no lead anodes, no lead impurities are present in the electrolytic cell. Cathode finish and the quality of the cathodes can be better than in conventional electrowinning. No anode sludges are created.

The new process is most suitable for use in connection with plants where $SO_2$ is generated at a location close to the electrowinning plant. If no other source is available, sulfur burning can be used to generate $SO_2$. Extra plant and extra investment costs for $SO_2$ handling may be necessary. A good option might be the utilization of anode bag technology. Another promising alternative would be the utilization of descending packed bed electrowinning cells.

The following examples are presented to illustrate but not to limit the present invention.

EXAMPLE 1

Figure 3:
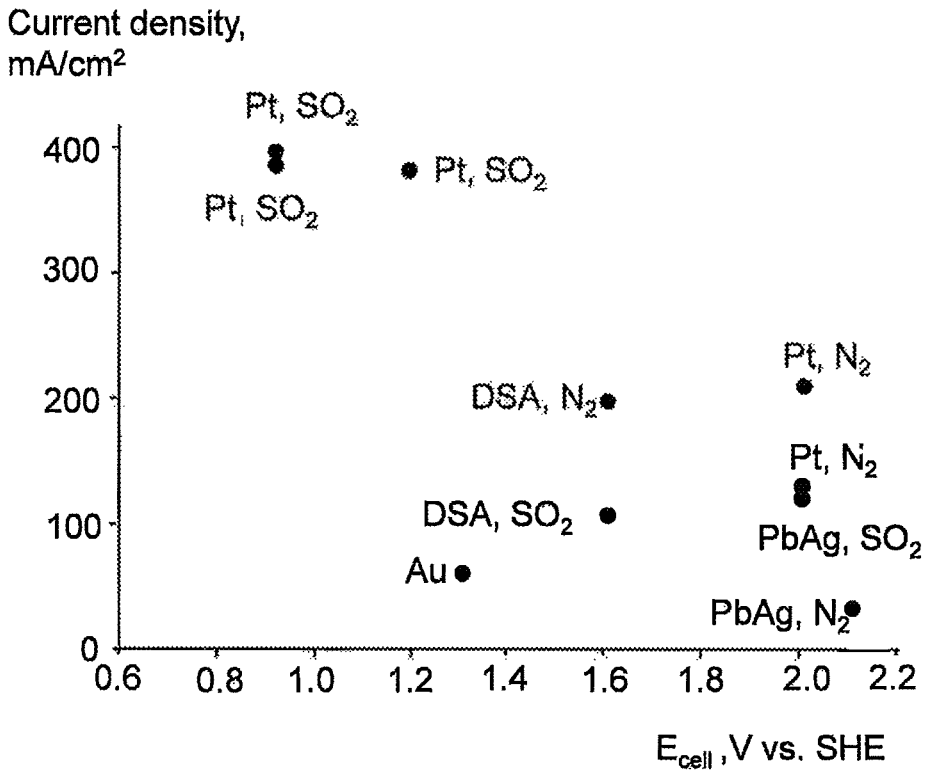
FIG. 3 is a diagram illustrating current densities as a function of applied potential with three tested anode materials in degassed electrolyte and an electrolyte with $SO_2$.

The effect of anode material on the sulfur dioxide depolarized electrolysis reaction was tested using a standard PbAg electrode normally used in zinc electrowinning, an oxygen evolving dimensionally stable anode (titanium mesh coated with $IrO_2$ and $Ta_2O_5$), and a platinum coated titanium mesh electrode for comparison. Polarization curves were measured in 100 g/dm$^3$ sulfuric acid, either degassed with nitrogen or saturated with $SO_2$. FIG. 3 discloses a summary of the current density as a function of applied potential from 10 mV/s scans of the tested three anode materials in degassed electrolyte and in an electrolyte with $SO_2$.

The results in FIG. 3 indicate that the least active electrode combination is a standard PbAg anode in a nitrogen degassed electrolyte. The most active combination so far was Pt in the presence of $SO_2$, giving high currents at a much lower voltage than the other combinations tested.

Other possible anode materials that can be used in sulfur dioxide depolarized electrolysis comprise a platinum coated dimensionally stable anode (Ti coated with Pt), which is an industrial version of bulk platinum anode, and a gold electrode. So far, the tests performed in laboratory scale suggest that gold is an active catalyst for the sulfur dioxide depolarized electrolysis reaction. The gold electrode can be made, for instance, by electroplating a substrate of stainless steel, titanium mesh, or any other suitable metal or metal alloy. Also other suitable coating methods can be employed, such as physical vapor deposition method and multiple layer coating.

Consequently, the most probable anode materials usable on industrial scale comprise a coated titanium anode (also known as a dimensionally stable anode, DSA) with a mixed metal and platinum or gold based coating, and a standard PbCaSn anode spray coated with platinum or gold powder, for instance by a method taught in WO 2007045716 A1. Also anodes produced by electrolytically plating stainless steel anode plates with gold or platinum, as well as anodes produced by physical vapor deposition of gold or platinum on a stainless steel anode can be used in the method according to the present invention.

EXAMPLE 2

To get an idea of the electrical energy consumption in copper electrowinning, the overall cell voltages ($U_{cell}$) and standard electrical energy consumptions (SEEC) of three different anodes were calculated for copper electrowinning. A summary of the results of these calculations is shown in Table 1. The calculations were made for the use of: a standard PbCaSn electrode in connection with oxygen evolving copper electrowinning; a dimensionally stable $IrO_2/Ta_2O_5$ electrode in connection with oxygen evolving copper electrowinning; and a platinum coated titanium electrode in connection with sulfur dioxide depolarized (SDD) copper electrowinning.

TABLE 1

| | PbCaSn | DSA $IrO_2/Ta_2O_5$ | Pt SDD with $SO_2$ |
|---|---|---|---|
| $U_{cell}$, [V] | 2.065 | 1.815 | 1.055 |
| SEEC/t Cu, [kWh/t] | 1834 | 1612 | 987 |

The results indicate that by using new platinum coated titanium electrodes in connection with sulfur dioxide depolarized copper electrowinning, remarkable reduction in the overall cell voltage and standard electrical energy consumption can be achieved.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method for electrowinning a metal from an electrolyte in an electrowinning cell that comprises an electrolysis tank, one or more anodes, and one or more cathodes, which anodes and cathodes are housed in the electrolysis tank, the method comprising supplying sulfur dioxide to the anode to depolarize the anode process and to reduce the energy consumption of the electrowinning cell, wherein housing each anode in an anode bag of its own and introducing sulfur dioxide into the lower part of the anode bag which anode bag comprises a diaphragm cloth bag or an ion exchange membrane.

2. The method according to claim 1, further comprising introducing sulfur dioxide in gas form into the electrolysis tank in the vicinity of the anode.

3. The method according to claim 1, further comprising dissolving sulfur dioxide into an electrolyte before introducing said electrolyte into the electrolysis tank in the vicinity of the anode.

4. The method according to claim 1, wherein the anodes are comprised of platinum coated titanium mesh.

5. The method according to claim 1, wherein the anodes are comprised of gold coated titanium mesh.

6. The method according to claim 1, wherein the anodes are PbCaSn anodes spray-coated with platinum powder.

7. The method according to claim 1, wherein the anodes are PbCaSn anodes spray-coated with gold powder.

8. The method according to claim 1, wherein the anodes are stainless steel anodes with platinum coating.

9. The method according to claim 1, wherein the anodes are stainless steel anodes with gold coating.

10. An electrowinning cell for electrowinning a metal from an electrolyte, comprising an electrolysis tank, one or more anodes and one or more cathodes, which anodes and cathodes are housed in the electrolysis tank, and means for supplying sulfur dioxide to the anode to depolarize the anode process, wherein each anode is housed in an anode bag of its own and the sulfur dioxide is supplied into the lower part of the anode bag which anode bag comprises a diaphragm cloth bag or an ion exchange membrane.

11. The electrowinning cell according to claim 10, wherein the means for supplying sulfur dioxide into the electrolysis tank comprises a manifold arranged to introduce sulfur dioxide into the vicinity of each anode.

12. The electrowinning cell according to claim 10, wherein the anode comprises a titanium mesh provided with a platinum coating.

13. The electrowinning cell according to claim 12, wherein the titanium mesh comprises 0.10-0.50 $g/cm^2$ titanium.

14. The electrowinning cell according to claim 12, wherein the titanium mesh comprises about 0.15 $g/m^2$ of titanium.

15. The electrowinning cell according to claim 10, wherein the anode comprises a titanium mesh provided with a gold coating.

16. The electrowinning cell according to claim 10, wherein the anode is a PbCaSn anode spray-coated with platinum powder.

17. The electrowinning cell according to claim 10, wherein the anode is a PbCaSn anode spray-coated with gold powder.

18. The electrowinning cell according to claim 10, wherein the anode is a stainless steel anode coated with platinum.

19. The electrowinning cell according to claim 10, wherein the anode is stainless steel anode coated with gold.

* * * * *